US007165907B2

(12) United States Patent
Levy

(10) Patent No.: US 7,165,907 B2
(45) Date of Patent: Jan. 23, 2007

(54) CHEWABLE TOOTHBRUSH

(76) Inventor: Keith Levy, 635 N. Dearborn Ave. Apartment 1904, Chicago, IL (US) 60610

( * ) Notice: Subject to any disclaimer, the term of this patent is extended or adjusted under 35 U.S.C. 154(b) by 347 days.

(21) Appl. No.: 10/852,550

(22) Filed: May 24, 2004

(65) Prior Publication Data

US 2005/0260027 A1 Nov. 24, 2005

(51) Int. Cl.
*B43M 11/06* (2006.01)

(52) U.S. Cl. ..... 401/183; 401/270

(58) Field of Classification Search ..... 401/132, 401/133, 183, 201, 270; 15/104.93
See application file for complete search history.

(56) References Cited

U.S. PATENT DOCUMENTS 3,853,412 A * 12/1974 Griffin ..... 401/183
4,149,815 A * 4/1979 Kawam ..... 401/201
5,678,273 A 10/1997 Porcelli ..... 15/104.94
5,794,774 A 8/1998 Porcelli ..... 206/369
5,911,319 A 6/1999 Porcelli et al. ..... 206/63.5
6,602,013 B1 8/2003 Clark ..... 401/282
2002/0106234 A1 8/2002 Johnson
2003/0138286 A1 7/2003 Clark

FOREIGN PATENT DOCUMENTS

GB 2351015 A * 12/2000

* cited by examiner

*Primary Examiner*—Huyen Le
(74) *Attorney, Agent, or Firm*—Neal Gerber & Einsenberg LLP

(57) ABSTRACT

A disposable or edible chewable toothbrush is disclosed for cleaning teeth between meals. The device includes a chewable bristle holder with bristles attached to the holder, a cavity formed within the holder, a substance within the cavity, and regions of weakness formed in the holder that prevent leakage of the contents of the holder until the device is compressed by chewing. In another embodiment, a disposable or edible brush is housed inside within a disposable or edible shell. Upon chewing, the shell is broken or dissolves thereby releasing its contents, which include the brush and possibly a dentifrice.

9 Claims, 7 Drawing Sheets

CHEWABLE TOOTHBRUSH

BACKGROUND OF THE DISCLOSURE

1. Field of the Invention

The present invention relates in general to tooth cleaning devices, and particularly, to edible and/or disposable chewing utensils that clean teeth and freshen breath between meals or regularly scheduled tooth brushing sessions.

2. Background Art

Consumer tooth cleaning devices designed to help individuals control plaque buildup on teeth have existed for many years and in a variety of forms. The most basic technique for controlling plaque formation is through the use of hand-held, disposable toothbrush appliances, commonly known as toothbrushes. Other forms of mechanical tooth brushing devices include hand-held electrically driven toothbrush heads/bristles or ultrasonic tooth cleaning devices, and handle-free, chewable toothbrushing devices, such as that disclosed in U.S. Pat. No. 6,602,013 B2. Non-mechanical devices for tooth cleaning include chewing gum, fluoride rinses, and anti-bacterial mouthwashes. Because each of these tooth cleaning options has varying benefits and drawbacks, consumers must balance an array of variables when choosing one device over another, such as purchase costs, cleaning effectiveness, convenience of use, etc.

Traditional hand-held toothbrushes purchased over-the-counter at retail outlets typically include an elongated handle formed from a thermoplastic, with nylon bristles securely embedded in rows at one end of the handle. A user of a traditional hand-held toothbrush typically applies toothpaste containing breath fresheners and fluoride, a known plaque inhibiter, to the bristles, and then gently scrubs the teeth with the bristles to mineralize the tooth enamel. For effective cleaning, a daily ritual of tooth brushing might include a session upon waking for the day and a session at the end of the day, with sparse opportunities, if any, throughout the day.

More expensive variations of the traditional toothbrush include hand-held, electrically driven toothbrush heads/bristles and ultrasonic tooth cleaning devices. Electrically driven devices such as these generally provide better cleaning results than traditional toothbrushes, but the lack of portability together with high initial and recurring costs of these devices sometimes dissuade users from purchasing these products altogether.

Significantly, however, traditional toothbrushes and the more modern electrically-driven devices suffer from a common shortcoming—they are impractical to use between meals throughout the day because they are too cumbersome, too costly, or rely on manipulation of a handle attached to the tooth brushing device to clean one's teeth and gums. Since consumers don't want to wait until the end of the day to have clean teeth and/or fresh smelling breath, consumers have resorted to more convenient but less effective options, such as chewing gum or rinsing with fluoride and/or anti-bacterial mouthwash formulations. Unfortunately, none of the non-mechanical alternatives provide the same level of tooth cleaning performance as compared to any of the hand-held mechanical tooth brushing devices. Therefore, it would be desirable to provide a mechanical, handle-less tooth brushing device having equivalent tooth cleaning and breath freshening characteristics as compared to traditional tooth brushing methods, and conveniently usable throughout the day between meals.

Clark, U.S. Pat. No. 6,602,013 B2, discloses a handle-less, chewable toothbrush with omni-directionally positioned bristles affixed to a resilient bristle anchor. The bristle anchor is made of a deformable material that returns to its original shape when not being chewed. Inside the bristle anchor is a cavity usable for holding a substance, such as a dentifrice, which is released upon biting into the chewable toothbrush. However, Clark neither teaches nor suggests a handle-less chewable toothbrush having a brush unattached and floating inside a temporary shell.

SUMMARY OF THE INVENTION

The present invention is directed to a toothbrush having a chewable shell formed from a resilient material and having an unstressed shape, the chewable shell being configured to compress upon itself in response to application of an external force, and return to the unstressed shape upon removal of the external force. The device further comprises a plurality of bristles attached to the chewable shell, a cavity formed within the chewable shell, a substance contained within the cavity, and a plurality of regions of weakness formed on the periphery of the chewable shell. The plurality of regions of weakness are operably configured to prevent leakage of the substance from inside the chewable shell before application of an external force, and configured to form a plurality of apertures through the chewable shell upon application of an external force to permit the substance to be released from within the cavity.

The plurality of bristles on the toothbrush of the present invention may have a fixed end attached to the chewable shell and an unconstrained free end. The plurality of bristles may be formed from a resilient material or from a dissolvable or digestible material. Preferably, the plurality of bristles have round, square, or triangular cross sections and may have a textured surface.

The substance contained in the cavity may comprise a dentifrice, and the cavity may also contain at least one shell stiffener. The at least one shell stiffener is preferably configured to follow the contour of the inner wall of the chewable shell.

In another embodiment of the present invention, the toothbrush comprises a shell, a cavity formed within the shell, and a brush comprising a plurality of bristles. The brush is operably configured to be contained within the cavity and the shell is configured to expose the brush upon application of an external force to the shell.

The cavity may contain a substance that is configured to become exposed upon application of the external force to the shell. Preferably, the substance comprises a dentifrice or a flavored breath freshener.

In an embodiment of the invention, the brush further includes a bristle holder, which is operably configured to apply a compressive force to the plurality of bristles to restrain each of the plurality of bristles with respect to one another. Preferably, the bristle holder comprises a coil compression spring, itself preferably comprising an edible material.

In an embodiment of the invention where each of the plurality of bristles have at least one end, the brush further includes a substantially incompressible core of cylindrical, spherical, ellipsoid, or rectangular shape for securely mounting one end of each of the plurality of bristles to form the brush. Preferably, the bristle core comprises an edible material.

In an embodiment of the invention, the shell is disposable. Alternatively, the shell may be made from an edible material capable of dissolving in one's mouth. Preferably, the edible material comprises cellulose or gelatin.

In an embodiment of the invention, the brush is made from an edible material. Preferably, the edible material comprises cellulose.

DETAILED DESCRIPTION OF THE INVENTION

Figure 1:
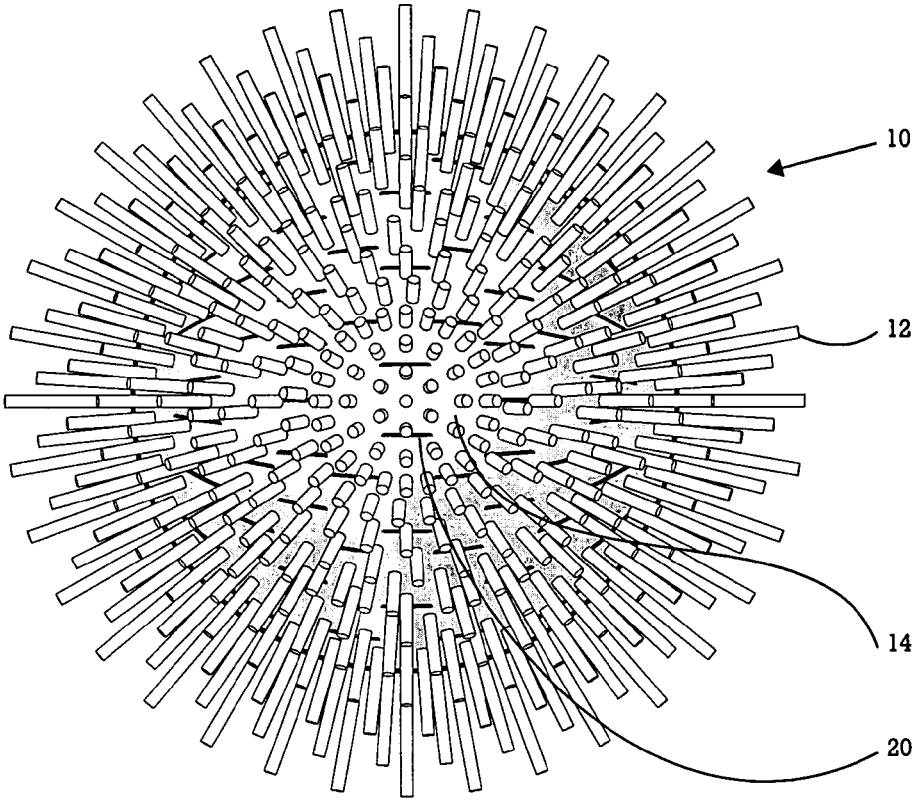
FIG. 1 is a perspective view of a chewable toothbrush according to one embodiment of the invention.

While this invention is susceptible of embodiment in many different forms, there are shown in the drawings and will herein be described in detail, certain preferred embodiments with the understanding that the present disclosure should be considered as an exemplification of the principles of the invention and is not intended to limit the invention to the embodiments so illustrated.

FIGS. 1–8 describe a chewable toothbrush according to one embodiment of the invention. Chewable toothbrush 10, as illustrated in FIG. 1, is generally spherical in shape in its unstressed state and includes bristles 12 for massaging gums and cleaning crevices in and around teeth. Bristles 12 originate from, and are embedded in, shell 14 (see also FIGS. 3–4) via an interference fit.

In a disposable configuration, bristles 12 may be made from any resilient, food-grade material (such as nylon, vulcanized rubber, etc.) to enable the bristles to reach deep inside tooth and gum crevices, yet are pliable enough to bend or "give" under ordinary chewing forces and return to their original shape when not under load. Alternatively, bristles 12 may be made from an edible material, such as cellulose that dissolves over time when warmed, chewed, or wetted by the mouth. FIGS. 1–8 show bristles 12 as having a round cross-section, uniform texture, uniform thickness, and uniform length, however, bristles 12 may instead be manufactured in a variety of cross sectional shapes, textures, lengths, and thicknesses, or combination thereof, to achieve optimum tooth cleaning performance. Bristles 12 are preferably manufactured with diameters of about 0.001 to about 0.05 inches and lengths of about 0.25 to about 0.5 inches. And while individual bristles 12 are shown uniformly positioned around spherical shell 14, they may instead be positioned non-uniformly around shell 14, possibly even in random patterns or groups. Individual bristles of small diameter may also be bundled with other individual bristles to form groups of individual bristles that are secured at a single attachment point in shell 14. Thus, each individual bristle shown in FIGS. 1–8 may actually comprise bundles of individual bristles. In addition, bristles 12 and shell 14, collectively, may be formed from a single, homogenous piece such that bristles 12 extend from shell 14 without any mechanical attachment means.

As shown in FIGS. 1–8, shell 14 is generally spherical in shape and is designed to securely retain bristles 12 to shell 14 using common techniques typical in the toothbrush manufacturing industry. Under normal chewing forces, shell 14 may temporarily collapse or deform (see FIGS. 4, 6, and 8), but may be prompted by material properties or internal supports to return to its original shape when the consumer is not biting down on chewable toothbrush 10. Shell 14 is preferably made of a resilient, food-grade material, such as vulcanized rubber, silicone rubber, etc. Shell 14 may alternatively be manufactured from an edible (i.e., digestible) food product that, when dry, is substantially rigid and inflexible, but may become more flexible and pliable when wet and/or warmed by a mouth, or may even dissolve altogether. Cellulose and gelatin are representative examples of dissolvable shell materials.

Shell 14 may be manufactured in a variety of thicknesses and outer diameters, ranging from about 0.002 to about 0.025 inches thick and about 0.25 to about 1.0 inches in diameter, depending on the market being served. For example, if the target market is teenage children whose mouths are smaller than those of grown adults, the diameter and thickness of shell 14 and/or length of bristles 12 can be decreased to enable more comfortable chewing. Likewise, if the target market is adults, then the diameter and thickness of shell 14 and/or length of bristles 12 can be increased to achieve more effective performance for adult teeth and gums.

Figure 2:
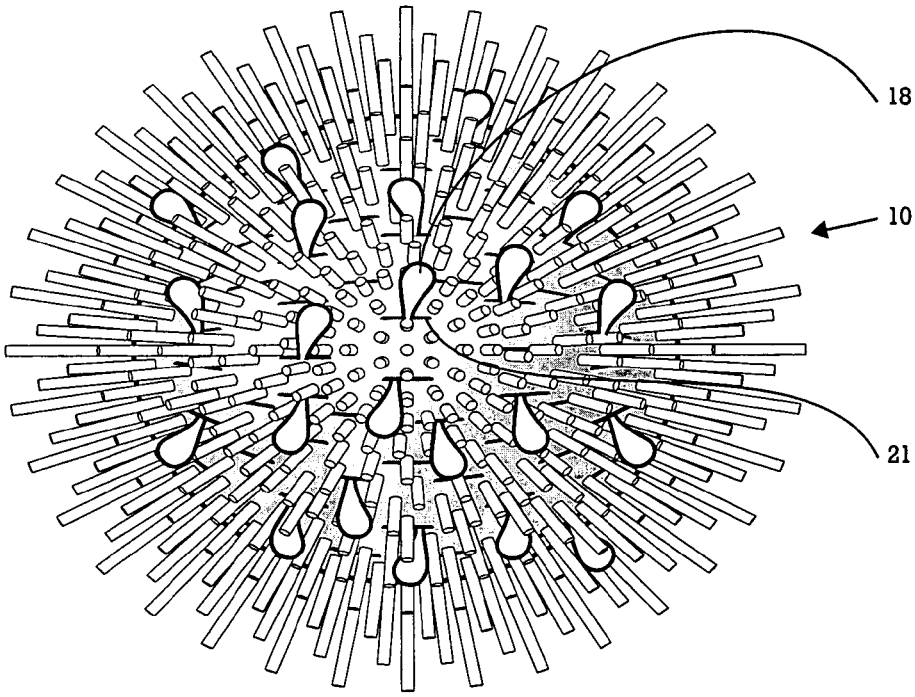
FIG. 2 is a perspective view of the chewable toothbrush according to the embodiment of FIG. 1, in partially collapsed form and showing optional contents of the device expelled or emitted therefrom.
Figure 3:
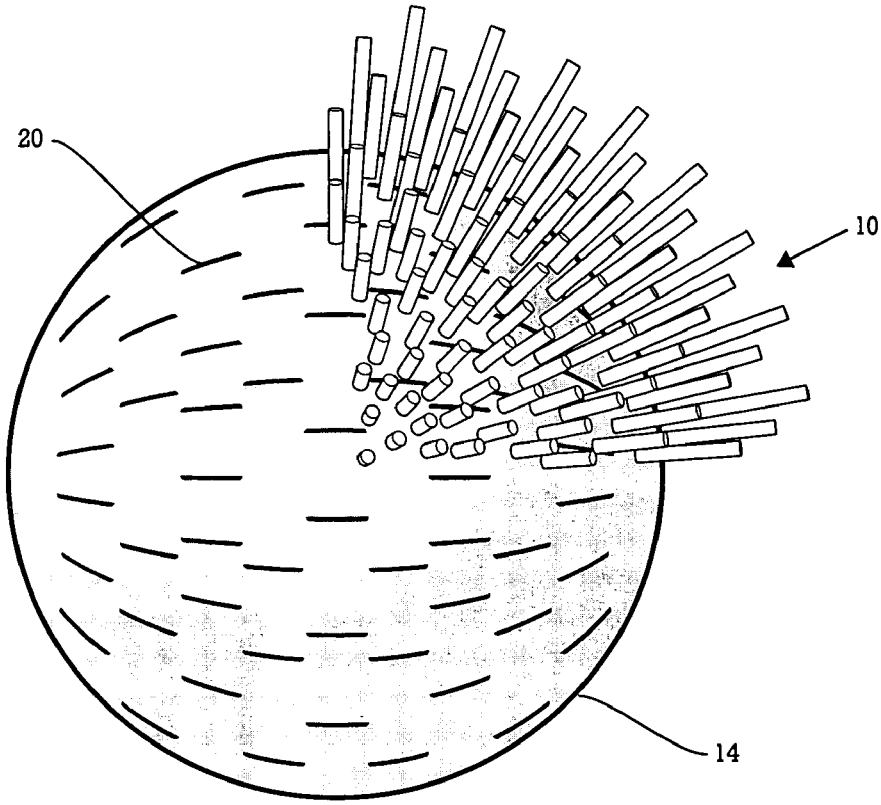
FIG. 3 is a detail perspective view of the chewable toothbrush of FIG. 1 showing areas or points of weakness in a shell.
Figure 4:
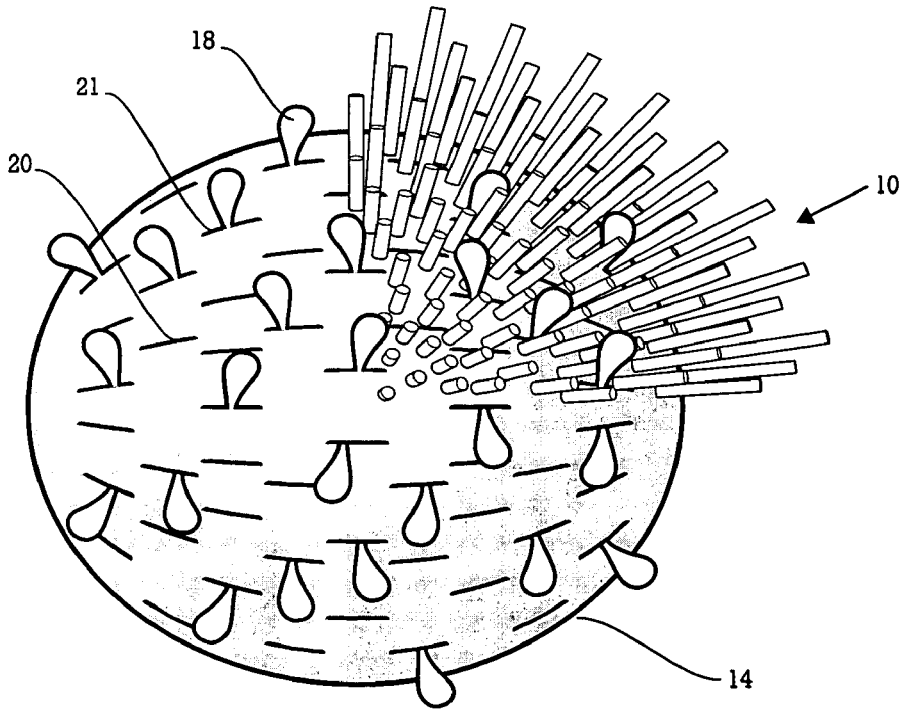
FIG. 4 is a detail perspective view of the chewable toothbrush of FIG. 1 in partially collapsed form and showing the contents of the device being expelled from the areas or points of weakness in the shell.

Inside shell 14 is void 16 (see FIGS. 5–8) that can optionally accommodate any number of substances 18 to help clean and/or whitening teeth, or to freshen one's breath. By way of example without intending to limit the types of substances that may be present, void 16 may contain fluoride toothpaste, whitening toothpaste, a flavored fluoride or non-fluoride rinse, an anti-bacterial mouthwash, a sugared or sugarless flavoring, or simply a breath freshener. Any substance 18 that is placed inside shell 14 in void 16 is permitted to escape into one's mouth during chewing, as illustrated in FIGS. 2 and 4, when shell 14 ruptures at one or more areas or points of weakness 20 fabricated in the outer surface of shell 14, as shown in FIGS. 1–4. Areas or points of weakness 20 preferably do not extend through the thickness of shell 14. Substance 18 may include a formulation intended either to be swallowed or expelled.

Figure 5:
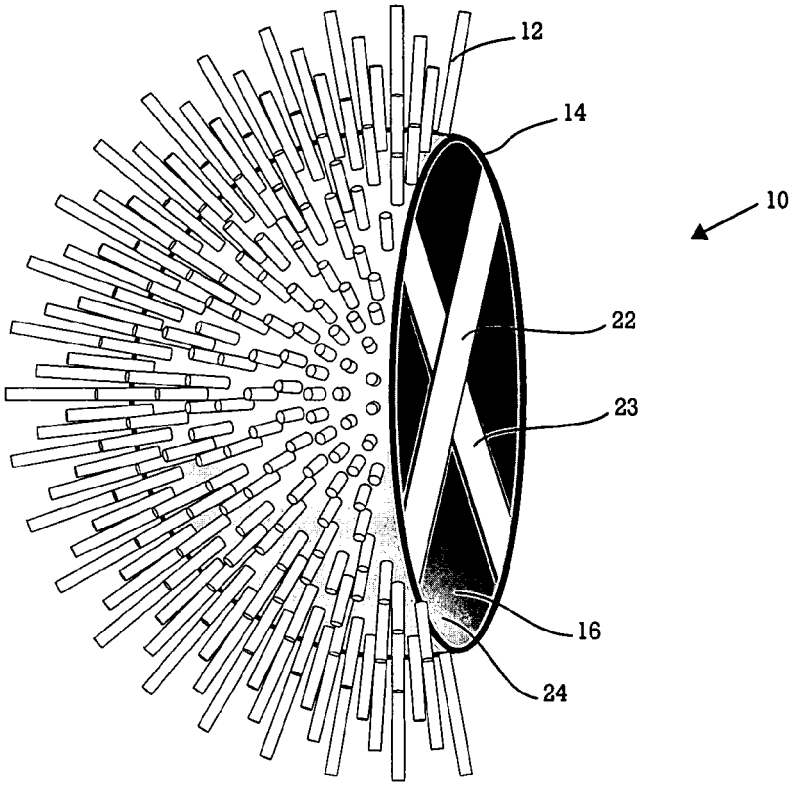
FIG. 5 is another perspective view, shown in partial section, of the chewable toothbrush of FIG. 1 and showing interior shell stiffening structures.
Figure 6:
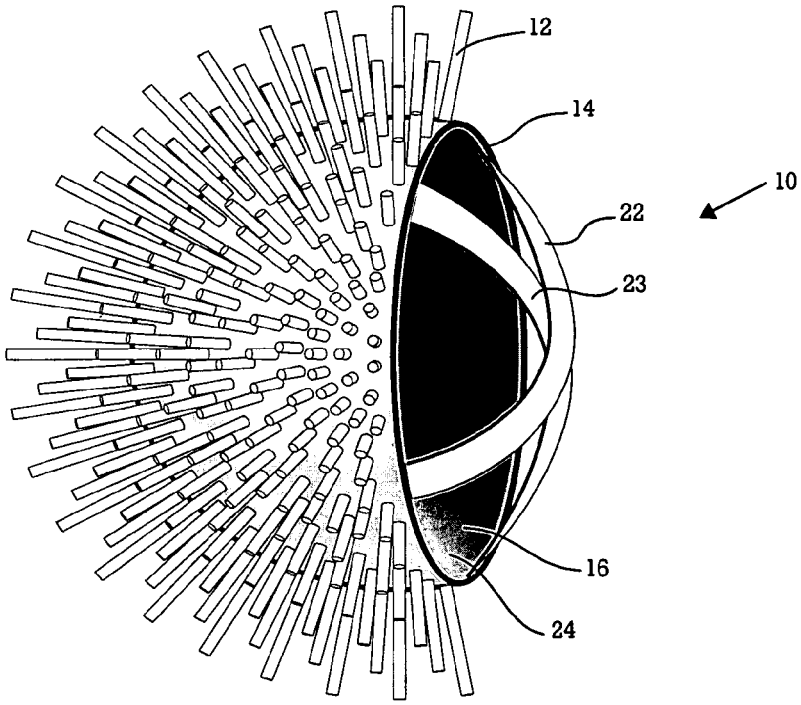
FIG. 6 is a yet another perspective view, shown in partial section, of the chewable toothbrush of FIG. 1 in partially collapsed form and showing interior shell stiffening structures.

FIGS. 5–6 show at least one optional shell wall spring stiffener 22, 23 inside shell 14 in void 16. Spring stiffener 22, 23 is usable to assist shell 14, if necessary, in maintaining the shell's original unstressed shape for long term chewing of chewable toothbrush 10. Under normal chewing forces, shell 14 will temporarily collapse or deform, as will spring stiffener 22, 23, but each will return to its original shape when the consumer is not biting down on chewable toothbrush 10. Spring stiffener 22, 23 is made from a resilient material that is optionally affixed to the inner wall 24 of shell 14 at each end of spring stiffener 22, 23.

Figure 7:
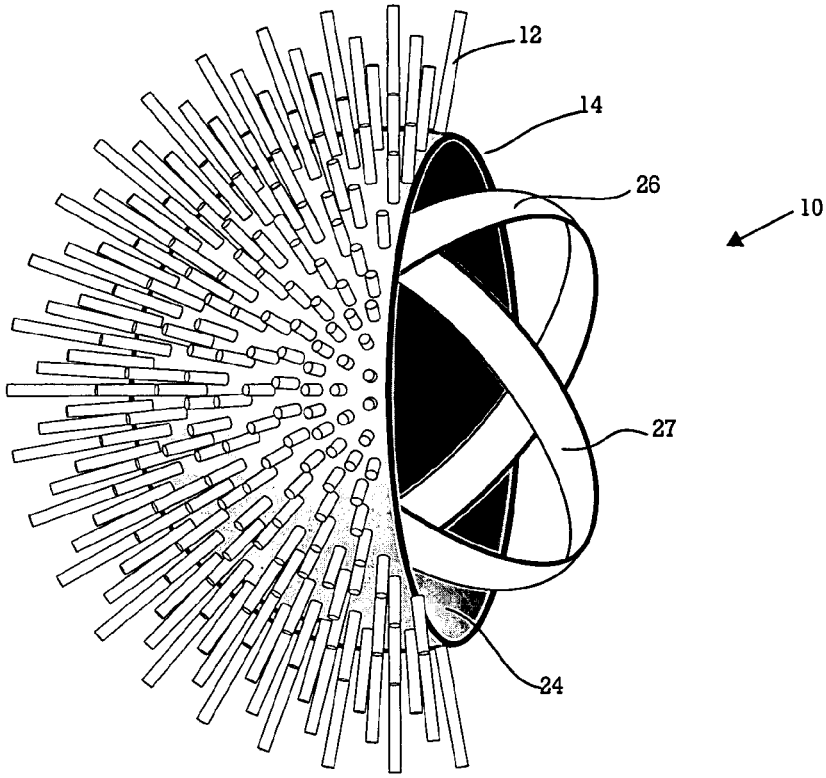
FIG. 7 is a perspective view, shown in partial section, of the chewable toothbrush of FIG. 1 showing an alternate form of interior shell stiffening structures.
Figure 8:
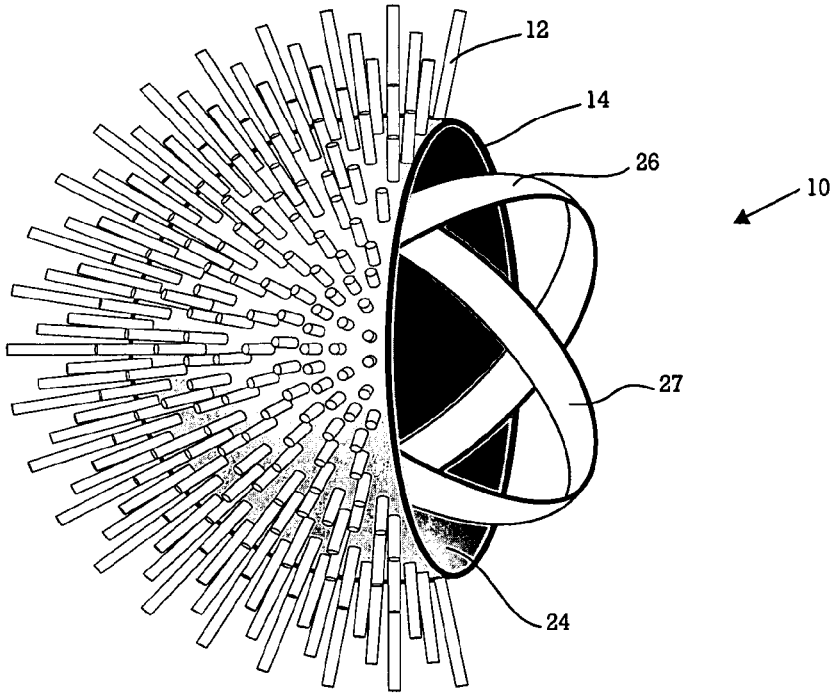
FIG. 8 is a perspective view, shown in partial section, of the chewable toothbrush of FIG. 1 in partially collapsed form and showing the alternate shell stiffening structures of FIG. 7.
Figure 9:
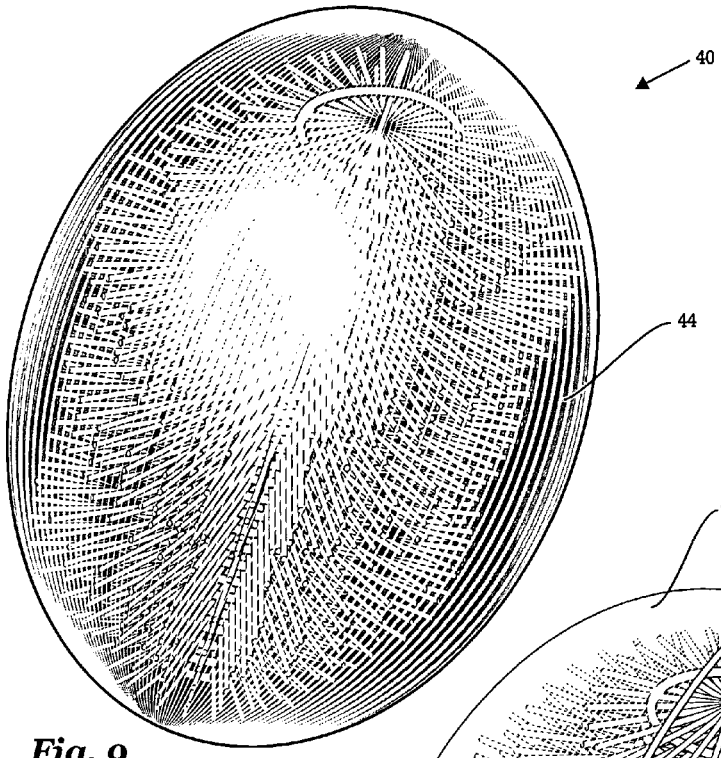
FIG. 9 is a perspective view of another embodiment of a chewable toothbrush with the brush floating inside a shell.
Figure 10:
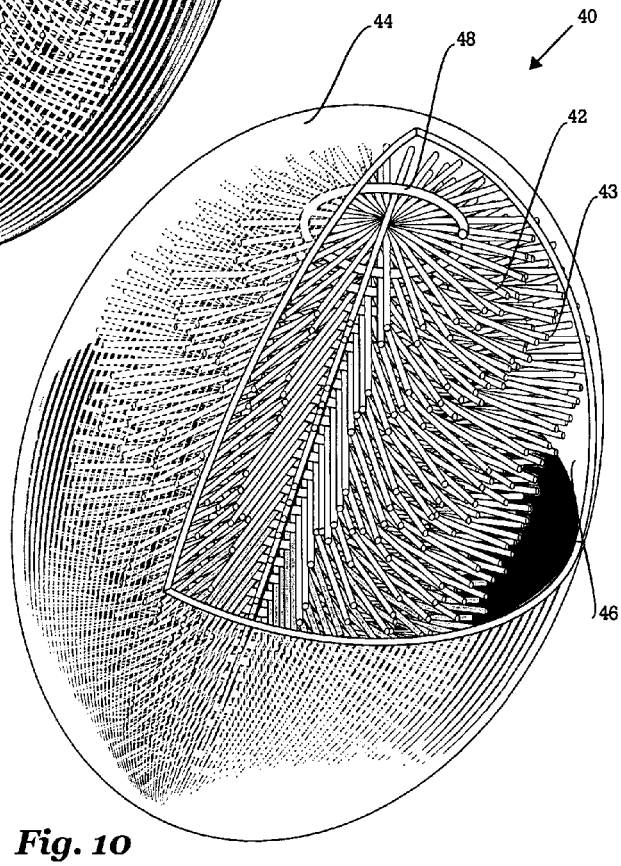
FIG. 10 is a cutaway perspective view of the chewable toothbrush of FIG. 9 showing the contents inside the shell.
Figure 11:
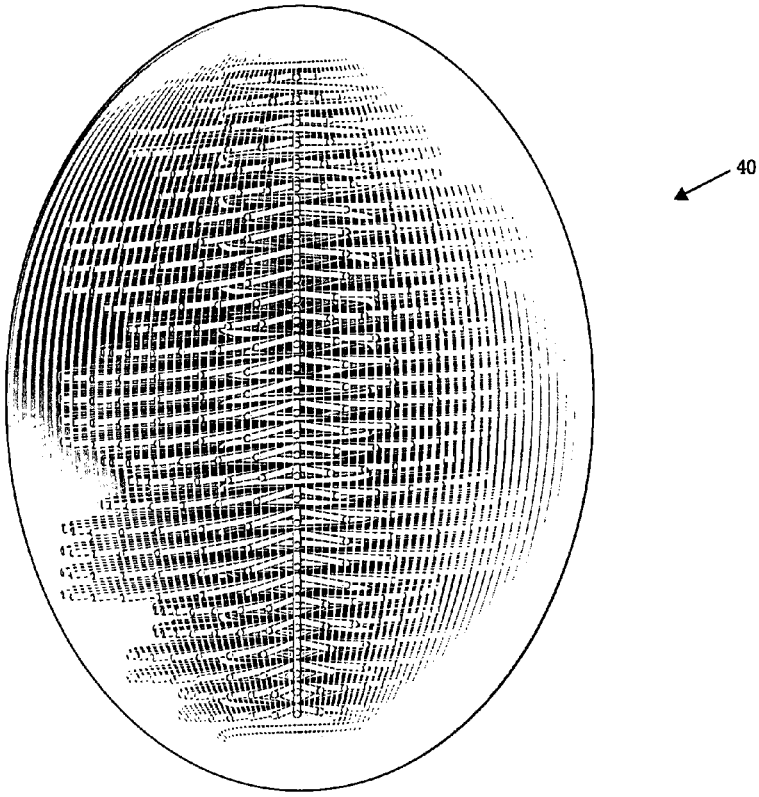
FIG. 11 is a side view of the chewable toothbrush of FIG. 9.
Figure 12:
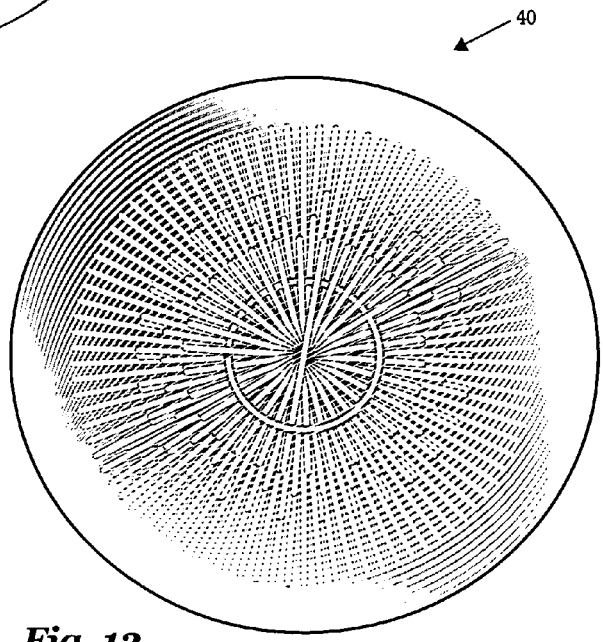
FIG. 12 is an end view of the chewable toothbrush of FIG. 9.
Figure 13:
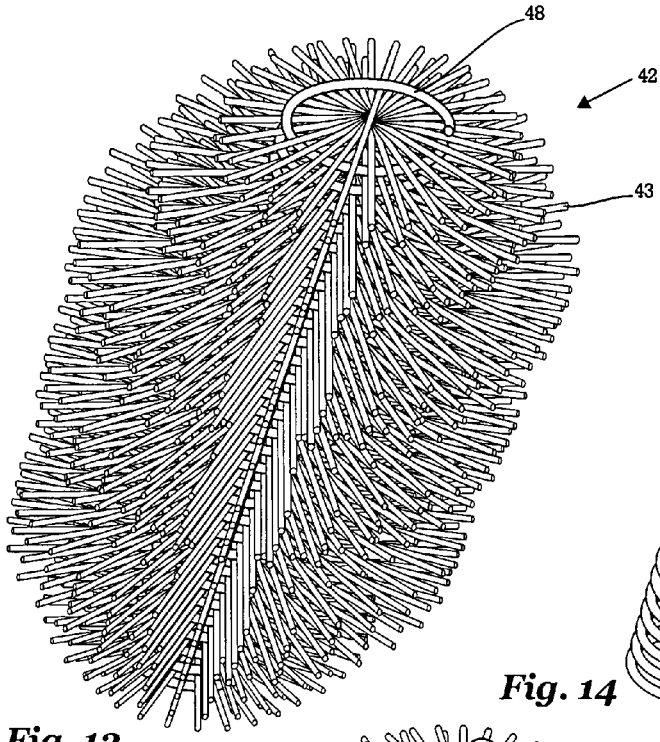
FIG. 13 is a perspective view of the brush of the chewable toothbrush of FIG. 9.
Figure 14:
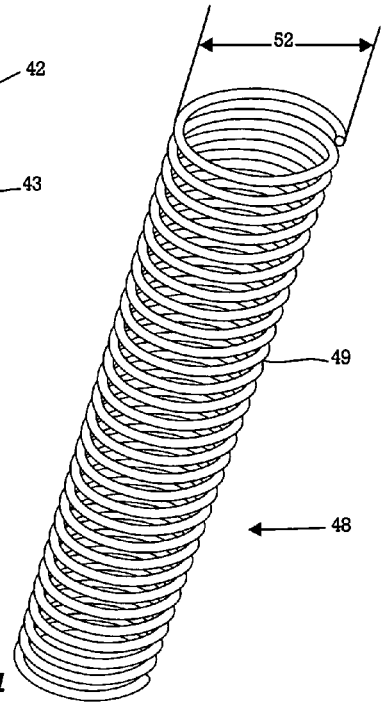
FIG. 14 is a perspective view of the bristle holder, in partial extension, of the brush of FIG. 13.
Figure 15:
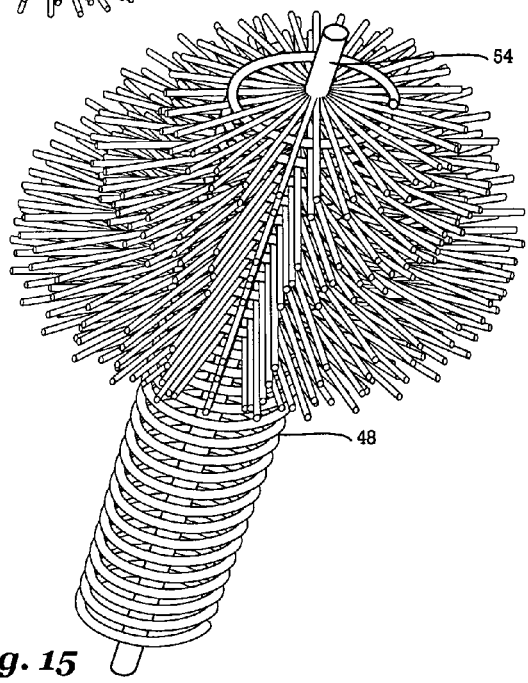
FIG. 15 is a perspective view partially showing the brush of FIG. 13, and additionally showing a cylindrical bristle core.

FIGS. 7–8 show at least one optional spring stiffener 26, 27 illustrated in yet another alternative configuration. Rather than being attached to inner wall 24 in void 16 of shell 14, spring stiffener 26, 27 is formed in the shape of a continuous hoop closely matching the contour of inner wall 24. In this configuration, if more than one spring stiffener is employed, one will nest inside another. Spring stiffeners 22, 23, 26, and 27 are shown in FIGS. 5–8 as being relatively flat to enhance their ability to nest one inside the other without undue deflection as each passes by the other in the center of void 16 (FIGS. 5–6) or at the inner wall 24 of void 16 (FIGS. 7–8). However, spring stiffeners 22, 23, 26, and 27 need not be constrained to any one particular configuration so long as their intended function of assisting shell 14 in maintaining the shell's original shape is not impeded. Any number or combination of spring stiffeners 22, 23, 26, and 27 may be employed.

Use of chewable toothbrush 10 between meals according to the present invention begins by placing a single chewable toothbrush 10 in one's mouth and chewing like ordinary chewing gum. Bristles 12, as shown and described above, behave like ordinary hand-held toothbrush bristles such that one's chewing and sloshing movements of chewable toothbrush 10 within one's mouth gently scrubs teeth and gums clean of food and plaque. Apertures 21 form in shell 14 when areas or points of weakness 20 split open during chewing of chewable toothbrush 10. If present, substance 18 is released from void 16 through apertures 21 in shell 14 to further one's enjoyment and/or enhance the cleaning effectiveness of chewable toothbrush 10 during chewing. The size and shape of apertures 21 may control the rate of release of substance 18 from void 16. For example, smaller openings may permit a slower rate of release of substance 18 while larger openings may permit a higher rate of release. Actual rates of release depend on the density and viscosity of substance 18 and the size of apertures 21.

When chewing is no longer desired, the user may simply dispose of chewable toothbrush 10, or alternatively, may save it for reuse at a later time. It should be noted that for chewable toothbrush 10 to function as described, shell 14 need not be spherical in shape but instead may optionally be formed in the shape of figurines or other geometric shapes, for example. In addition, chewable toothbrush 10, including shell 14, bristles 12, and any present shell spring stiffener 22, 23, 26 or 27 may optionally be fabricated from materials that slowly dissolve upon insertion into one's mouth. In this way, nothing need be expelled from one's mouth.

In another embodiment of the invention (not shown), substance 18 may instead cover the outside of shell 14 to partially or completely immerse bristles 12. In this configuration, shell 14 need not be hollow inside.

In another embodiment (not shown), shell 14 may be formed from an absorbent sponge-like material useful for helping a user expel, rather than swallow, substance 18 by reabsorbing substance 18 after a user is done chewing toothbrush 10.

In another embodiment (not shown), a plurality of blisters containing substance 18 may be formed sporadically on the outer surface (in and around bristles 12). Upon chewing, the blisters would break open (or dissolve) to release substance 18. Shell 14 need not be hollow in this configuration.

Another embodiment of the invention is illustrated in FIGS. 9–15. Chewable toothbrush 40 is shown as being generally ellipsoid in shape. In this embodiment, brush 42 is located entirely inside, and unattached to, shell 44 in void 46 rather than having bristles 43 affixed to shell 44. Shell 44 may be made from a relatively hard or relatively soft and/or compressible material, but preferably an edible material that dissolves or breaks open when chewed, wetted or warmed by the mouth. However, shell 44 may also be made from a non-edible, disposable material that readily breaks open, exposing its contents, when bitten into. As before, void 46 in shell 44 may optionally contain any number of substances 50 to help clean and/or whiten teeth, or to freshen one's breath. By way of example without intending to limit the types of substances that may optionally be present, void 46 may contain fluoride toothpaste, whitening toothpaste, a flavored fluoride or nonfluoride rinse, an anti-bacterial mouthwash, a sugared or sugarless flavoring, or simply a breath freshener. Any substance 50 that is placed inside shell 44 in void 46 is permitted to escape into one's mouth during chewing because shell 44 is made to readily dissolve and/or break open during chewing. Substance 50 may consist of a formulation intended either to be swallowed or expelled.

While shell 44 in FIGS. 9–12 is shown as being ellipsoid, as before, shell 44 may optionally be formed in any shape to enclose brush 42. Likewise, brush 42 can be manufactured in any shape so long as it can be carried within the volume dictated by the chosen shape of shell 44. Alternatively, a liquefied substance that solidifies at room temperature, such as a sugar-free candy, may be poured into a mold containing brush 42 and allowed to harden so that brush 42 is completely submerged within a solid mass. During use, the candy may dissolve or break up during chewing leaving brush 42 that can be chewed. Shell 44 of FIGS. 9–12 is preferably made from a material that will dissolve in one's mouth during chewing, such as gelatin or cellulose. Alternatively, shell 44 need not be present at all if substance 50 comprises a hardenable, dissolvable, edible material in sufficient quantity to either partially or completely envelop brush 42. In this way, substance 50 may dissolve or be broken apart during chewing leaving brush 42 in one's mouth to clean one's teeth. Brush 42 may also be manufactured from a dissolvable material having a different dissolution rate than that of substance 50 so no part of chewable toothbrush 40 need be discarded.

As shown in FIGS. 9–15, individual bristles 43 of brush 42 pass through a spring-like holder 48 as a means of securing individual bristles together. Coils 49 of holder 48 (see FIG. 14, with coils shown in partial extension) are preferably in compression so as to apply a compressive force on bristles 43 to hold the bristles in place. Individual bristles 43 are nested one next to the other and individually may vary in length from about 0.25 to about 1.0 inches. The outer diameter 52 of holder 48 may be sized in tandem with the length of the bristles to help prevent bristles 43 from bending excessively during chewing, thereby permitting bristles 43 to penetrate deep inside tooth crevices and gingiva. Alternatively, as partially shown in FIG. 15, bristles 43 may be embedded in, and originate from, a solid cylindrical, spherical, or rectangular bristle core to form brush 42, with bristles 43 being fed between coils 49 of holder 48. Bristle core 54 of this design could be used instead of holder 48, or in combination with holder 48, to firmly constrain bristles 43. Bristles 43 are shown in FIGS. 9–14 as having a round cross section, uniform texture, and uniform thickness, however, bristles 12 may instead be manufactured in a variety of cross sectional shapes, textures, lengths, and thicknesses, or combination thereof, to enable efficient packaging within shell 44 and to achieve optimum tooth cleaning performance. Bristles 12 are preferably manufactured with diameters of about 0.001 to about 0.05 inches.

The foregoing description and drawings merely explain and illustrate the invention, and the invention is not so limited as those skilled in the art who have the disclosure before them will be able to make modifications and variations therein without departing from the scope of the invention.

What is claimed is:

1. A toothbrush, comprising:

a chewable shell, the chewable shell being formed from a resilient material and having an unstressed shape, the chewable shell being configured to compress upon itself in response to application of an external force, and return to the unstressed shape upon removal of the external force;

a plurality of bristles attached to the chewable shell;

a cavity formed within the chewable shell;

a substance contained within the cavity; and a plurality of regions of weakness formed on the periphery of the chewable shell, the plurality of regions of weakness operably configured to prevent leakage of the substance from inside the chewable shell before application of the external force, and configured to return to form a plurality of apertures through the chewable shell upon application of the external force to permit the substance to be released from within the cavity.

2. The toothbrush according to claim 1, wherein each of the plurality of bristles has a fixed end attached to the chewable shell and an unconstrained free end.

3. The toothbrush according to claim 2, wherein each of the plurality of bristles is formed from a resilient material.

4. The toothbrush according to claim 2, wherein each of the plurality of bristles is made from a dissolvable or digestible material.

5. The toothbrush according to claim 2, wherein each of the plurality of bristles has a cross-section that is one of: round, square, or triangular.

6. The toothbrush according to claim 5, wherein the plurality of bristles have a textured surface.

7. The toothbrush according to claim 1, wherein the substance comprises a dentifrice.

8. The toothbrush according to claim 1, wherein the cavity contains at least one shell stiffener.

9. The toothbrush according to claim 8 in which the chewable shell further includes an inner wall having a contour, wherein the at least one shell stiffener is configured to follow the contour of the inner wall of the chewable shell.

* * * * *

UNITED STATES PATENT AND TRADEMARK OFFICE

CERTIFICATE OF CORRECTION

PATENT NO. : 7,165,907 B2
APPLICATION NO. : 10/852550
DATED : January 23, 2007
INVENTOR(S) : Keith Levy It is certified that error appears in the above-identified patent and that said Letters Patent is hereby corrected as shown below:

Column 8, Line 5 delete “return” and replace with --rupture--.

Signed and Sealed this

Thirteenth Day of March, 2007

JON W. DUDAS
*Director of the United States Patent and Trademark Office*